US005136610A

United States Patent [19]

Heuss

[11] Patent Number: 5,136,610

[45] Date of Patent: Aug. 4, 1992

[54] SYSTEM FOR CARRYING A CHARGE IN A REHEATING FURNACE

[75] Inventor: Helmut Heuss, Ratingen, Fed. Rep. of Germany

[73] Assignee: LOI Essen Industrieofenanlagen GmbH, Essen, Fed. Rep. of Germany

[21] Appl. No.: 648,544

[22] Filed: Jan. 30, 1991

[30] Foreign Application Priority Data

Feb. 1, 1990 [DE] Fed. Rep. of Germany ..... 4002870

[51] Int. Cl.[5] ..... H05B 3/00

[52] U.S. Cl. ..... 373/109; 373/117; 373/127; 432/233; 432/234; 432/235; 432/236; 432/239; 432/121

[58] Field of Search ..... 432/234, 233, 235, 236, 432/239, 121-127; 373/79, 80, 81, 127, 117, 109

[56] References Cited

U.S. PATENT DOCUMENTS 3,214,152 10/1965 Molz ..... 432/235
3,367,641 2/1968 Molz ..... 432/235
4,056,351 11/1977 Knaak ..... 432/235
4,293,299 10/1981 Gaddes ..... 432/234
4,689,009 8/1987 Heuss ..... 432/234
4,900,248 2/1990 Terai et al. ..... 432/234

FOREIGN PATENT DOCUMENTS 2505179 8/1976 Fed. Rep. of Germany ..... 432/234

*Primary Examiner*—Bruce A. Reynolds
*Assistant Examiner*—Tu Hoang
*Attorney, Agent, or Firm*—Blakely, Sokoloff, Taylor & Zafman

[57] ABSTRACT

The system comprises at least one coolant-carrying tubular support carrying at least one rider. The latter consists of a heat-resistant cast housing provided with at least one cutout into which a ceramic carrier is inserted. The carrier is of sufficient compressive strength even at a temperature in excess of 1,200° C. The housing remains at a temperature below 1,200° C. and therefore provides a very good support for the carrier which it holds and transfers the loads that occur into the tubular support. The housing is detachably connected with the tubular support by means of a bolt.

15 Claims, 2 Drawing Sheets

SYSTEM FOR CARRYING A CHARGE IN A REHEATING FURNACE

BACKGROUND OF THE INVENTION

1. Field of the Invention

The present invention relates to a system for carrying a charge, such as a slab, a billet or a bloom through a reheating furnace, and more particularly a walking-beam furnace, the system comprising at least one tubular support carrying a coolant and at least one rider resistant to high temperature arranged on the tubular support.

2. Prior Art

Known systems for carrying a charge through a reheating furnace, as described in European patent No. EP 0 184 021 B1 which corresponds to U.S. Pat. No. 4,689,009, feature riders which are castings resistant to high temperatures. Such castings may be exposed to temperatures of up to approximately 1,200° C. They have excellent strength properties up to the temperature, but at a temperature above 1,200° C. their strength properties are no longer sufficient for usual applications. Charges, such as in particular slabs or similar products to be reheated for rolling, may on the other hand be reheated to a temperature which is 50° C. to 100° C. higher than the temperature to which known castings may be exposed. Since known riders must be kept at a temperature below the limit temperature to which castings may be exposed, the temperature difference produces necessarily marks in the charge commonly referred to as skid marks. The skid marks represent low-temperature areas which affect final product quality., since they cause differences in thickness and width as well as in product microstructure unless relatively complicated action is taken to remove the skid marks prior to rolling. The importance of the disadvantages associated with the skid marks is increasing, as product quality specifications become increasingly stringent.

SUMMARY OF THE INVENTION

It is an object of the present invention to provide for a system for carrying a charge in a reheating furnace, allowing extremely uniform charge reheating under advantageous production and operating conditions.

The present invention therefore proposes a system wherein the rider comprises a heat-resistent cast housing placed on the tubular support and detachably connected therewith, the housing has at least one cutout facing upwards with a dovetail-like appearance transverse to the longitudinal tubular support direction, the cutout being limited by a front wall at one end, and a locking device at the opposite end, and a carrier substantially made from a ceramic material is placed into the housing cutout, the carrier having an upper part with a surface to carry the charge and a lower part of a dovetail-like appearance transverse to the longitudinal tubular support direction.

The rider proposed by the present invention benefits from the excellent strength properties of heat-resistant steel castings at temperatures below 1,200° C. and combines the properties with the excellent compressive strength of ceramic materials at temperatures above 1,200° C. The housing of the rider proposed herein is a heat-resistant steel casting. It protects the ceramic carrier and transmits the loads that occur into the tubular support which carries a coolant. The ceramic carrier of the proposed rider is only exposed to a compressive load and will not fail even when exposed to the load at the temperature required for uniform charge reheating. The carrier and the charge are therefore at the same temperature, preventing the occurrence of skid marks in the charge. Temperature distribution in the charge is hence extremely uniform, allowing the fabrication of final products of excellent quality.

The material used for the carrier may be any ceramic material or any metal ceramic material or any of the two groups of materials combined with another material provided that the compressive strength is sufficiently high at a very high temperature.

The cost of manufacturing the system proposed by the present invention is not particularly high. The service life of the system proposed is above average, on the one hand because of the materials selected in accordance with the teachings of the present invention and on the other hand because of the advantageous thermal behavior of the proposed system which allows for thermal expansion. It is another advantage of the present invention that maintenance is facilitated by the fact that the riders detachably mounted on their tubular supports may be replaced easily.

The housing of the rider proposed herein provides an excellent support for the ceramic carrier. The dovetail-like interaction of the two parts of said rider prevent the ceramic carrier from being displaced from the housing. For assembly, the carrier is inserted into the housing in the longitudinal direction and then locked in place by the locking device provided for. The latter is of the welded type but may be detachable if it is considered important to make provision for the separate replacement of the carrier. In a preferred embodiment of the present invention, the front wall of the housing of the rider is at the rider's downstream end when viewed in direction of charge travel.

It is advantageous for the front wall to be rounded transverse to the longitudinal tubular support direction.

According to the teachings of the present invention, a gap is situated between the carrier and the cutout in the housing, the gap being filled with ceramic fiber, mortar or a similar material. The arrangement described facilitates the transmission of loads and minimizes heat loss by heat transfer to the cooled tubular support. It also accommodates manufacturing tolerances and irregularities in surface shapes.

The upper part of the carrier proposed herein may be rounded transverse to the longitudinal tubular support direction. In a preferred embodiment, it is mushroom-shaped and straddles the housing cutout, thereby preventing the ingress of foreign matter.

In an alternative embodiment proposed by the present invention, the upper part of the carrier to the surface for carrying the charge continues the dovetail-shaped form of the lower part of the carrier. The carrier surface may also be rounded in the case of the alternative embodiment, thereby providing a particularly simple form.

In another advantageous embodiment of the present invention, the housing of the rider proposed herein straddles a land on the tubular support, a bolt being inserted through the land and the housing transverse to the longitudinal tubular support direction. It is an advantage of the design described that it is simple and allows the easy replacement of the complete rider without any cutting or welding work.

According to a further embodiment of the present invention, the housing of the rider proposed straddles the upper tubular support part while insulating material is provided to surround the remainder of the tubular support. In the design described, the rider is advantageously integrated into the overall system. The design may be improved by gaps filled with ceramic fibers being provided between the housing and the insulating material.

The individual characteristics and advantages of the present invention divulged hereinbefore may be combined in a multiplicity of different manners which are not described and listed exhaustively hereinabove.

BRIEF DESCRIPTION OF THE DRAWING

The present invention will now be described in a non-limitative way with the help of preferred embodiments illustrated in the accompanying drawing, in which.

DETAILED DESCRIPTION OF THE PRESENT INVENTION

Figure 2:
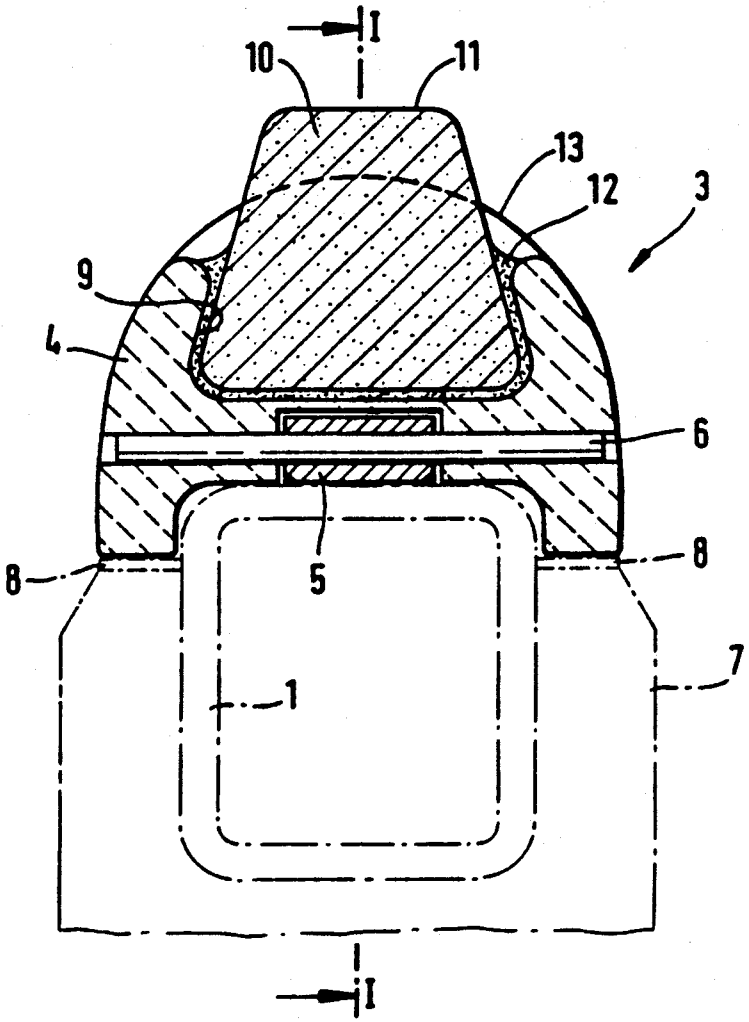
FIG. 2 is a vertical section along line II—II in FIG. 1.
Figure 1:
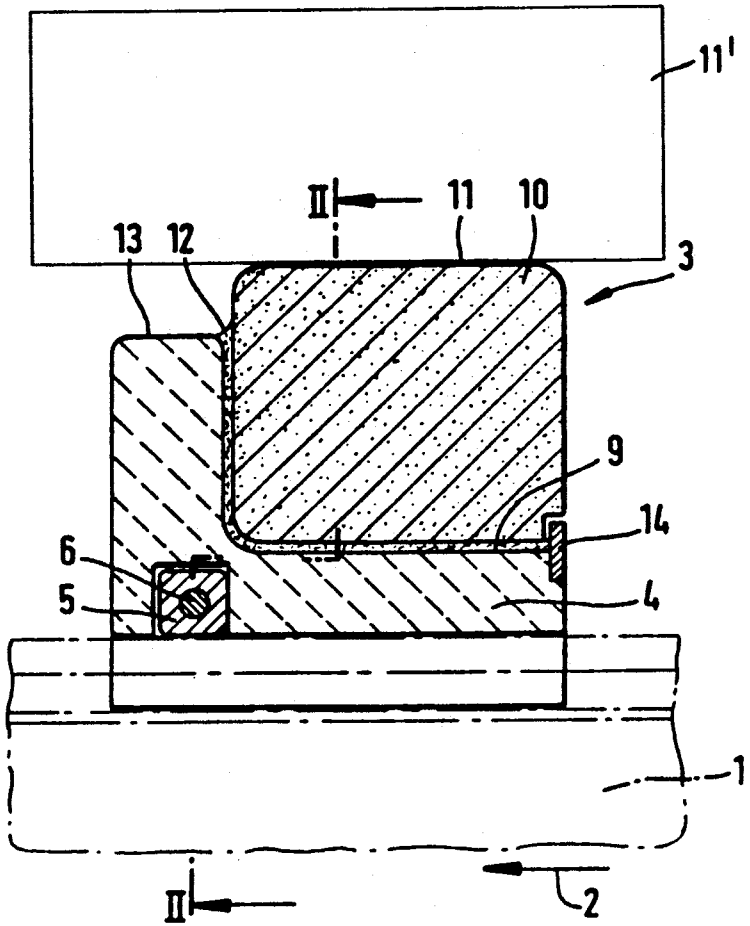
FIG. 1 is a vertical section of an embodiment of the present invention along line I—I in FIG. 2.

The embodiment of the present invention depicted in FIGS. 1 and 2 comprises a tubular support 1 arranged in the longitudinal direction of a furnace, the direction of charge travel being indicated by arrow 2 in FIG. 1. A coolant, such as steam or water, flows through the tubular support 1 for cooling the tubular support 1.

The tubular support 1 carries a multiplicity of riders 3, each rider 3 having a housing 4 straddling a land 5 welded to said tubular support 1. A bolt 6 is inserted through the housing 4 and the land 5, thereby preventing the housing 4 from being lifted off the tubular support 1 by charge moving through the furnace. The bolt connection is detachable for easy assembly and disassembly.

As shown in FIG. 2, the housing 4 straddles the upper part of the tubular support 1 and adjoins an insulation 7 surrounding the rest of the tubular support 1. Gaps 8 between the housing 4 and the insulation 7 are filled with ceramic fiber material. The configuration provides for good thermal insulation between the cooled tubular support 1 and the heated furnace chamber.

The housing 4 is provided with a cutout 9 facing upwards into which a carrier 10 made from ceramic material is inserted. The carrier 10 has a surface 11 to carry the charge 11.

The embodiment of the present invention depicted in FIGS. 1 and 2 may be used in a walking-beam furnace operated reheat slabs for rolling. Such slabs are reheated to a temp of approximately 1,300 ° C. The ceramic carrier provided for in the present invention is fit for such a high temperature and features sufficient compressive strength at this high temperature. In the configuration depicted herein, the load applied by the charge is transferred to the tubular support 1 across housing 4 which is a steel casting for elevated temperature service. The temperature of the housing 4 is kept slightly below 1,200 ° C. by the cooled tubular support 1. At such a temperature, the strength properties of such a steel casting are excellent.

It is a main advantage of the present invention that the rider 3 consisting of the housing 4 and the carrier 10 allows very uniform charge reheating without producing any skid marks. The rider divulged by the present invention provides an optimum combination of the high temperature resistance of ceramic material and the excellent strength properties of steel castings at lower temperatures.

A gap 12 is formed between the housing 4 and the carrier 10 of the rider 3 proposed by the present invention. In the embodiment of the present invention depicted in FIGS. 1 and 2, the gap 12 is filled with ceramic fibers providing additional thermal insulation, supporting the carrier 10, assuring advantageous load transfer between the carrier 10 and the housing 4 and making up for surface irregularities due to manufacturing tolerances which may cause a mismatch between carrier 10 and housing 4.

As depicted in FIG. 2, the cutout 9 of the housing 4 of the embodiment of the present invention is of a dovetail shape when viewed in the longitudinal direction of the tubular support 1. The shape of carrier 10 is complementary, extending to surface 11. In the longitudinal direction, the cutout 9 is limited by a rounded front wall 13 at one end and by a locking device 14 at the other end. The locking device 14 is welded to housing 4. The arrangement allows the carrier 10 to be inserted into cutout 9 in the longitudinal direction, the gap 12 being thereupon filled with ceramic fiber material and locking device 14 being thereafter secured. The arrangement shown in FIG. 2 securely holds carrier 10 in place and prevents the carrier 10 from being pushed out of cutout 9 by the charge travelling through the furnace. The configuration is, nevertheless, simple, allowing easy manufacture and assembly.

The cross-section of the carrier of the rider proposed by the present invention may be different from the cross-section depicted in FIG. 2 as long as the charge is supported at a sufficient distance above housing 4.

Figure 3:
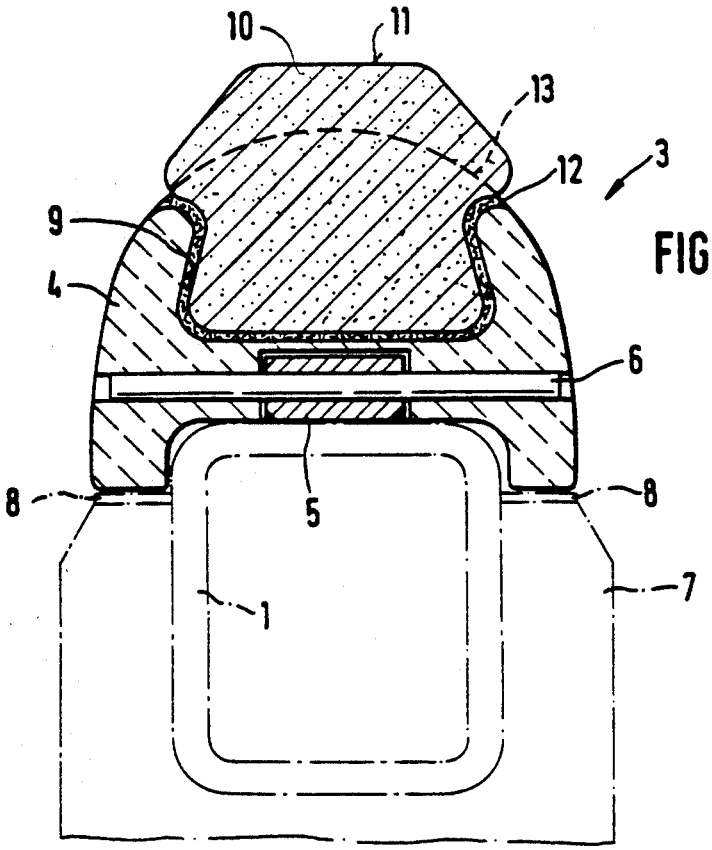
FIG. 3 is a section of a different embodiment of the present invention similar to the section in FIG. 2.

In the embodiment of the present invention depicted in FIG. 3, the carrier 10 is, for example, mushroom-shaped. The carrier straddles the side walls of housing 4, thereby preventing the ingress of dirt and other foreign matter.

Figure 4:
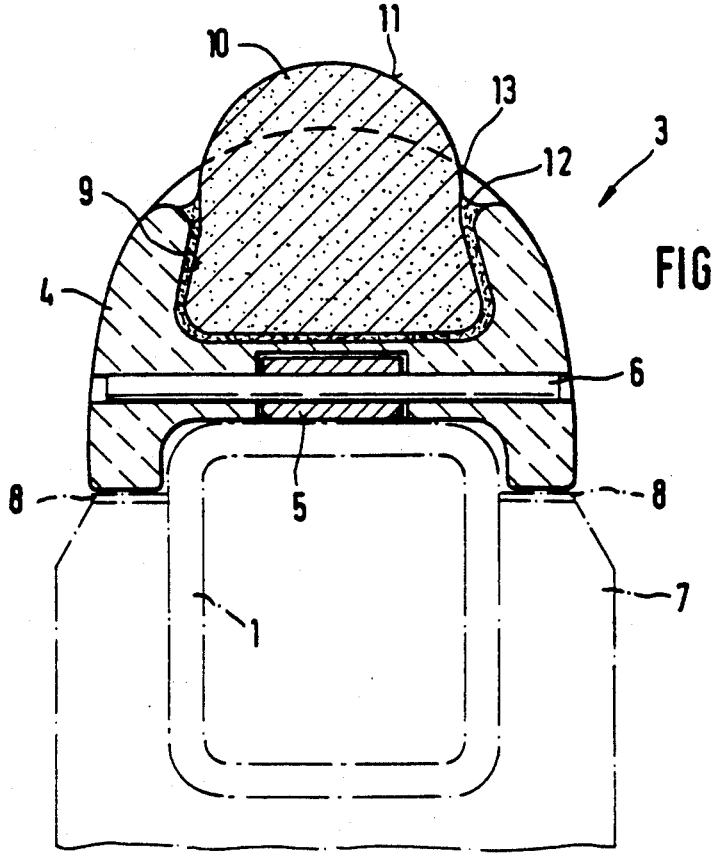
FIG. 4 is a section of a further embodiment of the present invention similar to the sections in FIGS. 2 and 3.

In the embodiment of the present invention depicted in FIG. 4, the upper part of the carrier 10 is rounded, thereby minimizing the contact between the carrier and the charge.

The present invention is most advantageously employed in an environment with the temperature conditions described herein, but it may also be used under different temperature conditions. The present invention is further not limited to riders for walking-beam furnaces but may be exploited for other furnaces, such as walking-hearth furnaces or pusher-type furnaces.

The present invention allows a wide range of variations and combinations. The embodiments of carrier 10 depicted in FIGS. 2 and 3 may, for example, have a rounded surface 11 of the type shown in FIG. 4. The locking device 14 in FIG. 1 may alternatively be connected detachably with housing 4, for example by simple insertion, to facilitate the replacement of carrier 10. Further, in lieu of ceramic fiber, mortar may be used to fill the gap 12 between the carrier 10 and the housing 4 or to fill the gap 8 shown in FIG. 2. In yet another embodiment of the present invention, the arrangement depicted in FIG. 1 may be reversed by moving front wall 13 to the back and locking device 14 to the front, with land 5 preferably also being moved in this case. The land 5 may alternatively be arranged laterally, bolt 6 being replaced by a different locking system if this arrangement is chosen. It should also be noted that each housing may accommodate a multiplicity of carriers.

I claim:

1. A system for carrying a charge in a reheating furnace, said system comprising:

A. at least one tubular support suitable for carrying a coolant, said tubular support defining a longitudinal tubular support direction; and B. at least one rider resistant to high temperature arranged on said tubular support and serving to carry said charge, said rider comprising (i) a heat-resistant cast housing placed on said tubular support and detachably connected therewith, said housing having at least one cutout facing upwards with a dovetail-like appearance transverse to said longitudinal tubular support direction, said cutout being limited by a bottom, a wall at one end of said cutout and a locking device at the opposite end of said cutout, and (ii) at least one carrier made in large part from a ceramic material and having at least one upper part and at least one lower part wherein a gap is formed between said carrier and said at least one cutout of said housing, said gap being filled by a ceramic fiber material thereby said rider facilitates a transmission of loads, minimizes heat loss by heat transfer to said tubular support, and accommodates manufacturing tolerances and irregularities in surface shapes, said upper part of said carrier having a surface to carry said charge and said lower part of said carrier having a dovetail-like appearance transverse to said longitudinal tubular support direction and being placed into said at least one cutout of said housing.

2. A system according to claim 1 wherein said wall of said cutout transverse to said longitudinal tubular support direction is rounded.

3. A system according to claim 1, wherein said gap is filled by at least one of ceramic fiber and mortar.

4. A system according to claim 1 wherein the upper part of said carrier is rounded transverse to said longitudinal tubular support direction.

5. A system according to claim 1 wherein the upper part of said carrier is mushroom-shaped transverse to said longitudinal tubular support direction.

6. A system according to claim 1 wherein a shape of the upper part of said carrier transverse to said longitudinal tubular support direction is defined by sides having the same slope as the sides of the lower part of said carrier.

7. A system according to claim 1 wherein said housing straddles a land of said tubular support and a bolt is inserted through said land and said housing transverse to said longitudinal tubular support direction.

8. A system according to claim 1 wherein said tubular support consists of an upper part and a lower part, said housing straddles said upper tubular support part, an insulation is provided to surround said lower tubular support part and said housing adjoins said insulation.

9. A furnace for reheating a charge, said furnace comprising

A. at least one tubular support suitable for carrying a coolant, said tubular support defining a longitudinal direction; and B. at least one rider resistant to high temperature arranged on said tubular support and serving to carry said charge, said rider comprising (i) a heat-resistant cast housing placed on said tubular support and detachably connected therewith, said housing having at least one cutout facing upwards with a dovetail-like appearance transverse to said longitudinal direction of said tubular support, said cutout being limited by a bottom a wall at one end, and a locking device at the opposite end, and (ii) at least one carrier made in large part from a ceramic material and having at least one upper part and at least one lower part, said upper part of said carrier having a surface to carry said charge and said lower part of said carrier having a dovetail-like appearance transverse to said longitudinal tubular support direction and being placed into said housing cutout.

10. A rider resistant to high temperature for carrying a charge in a reheating furnace, said rider comprising A. a heat-resistant cast housing defining a longitudinal housing direction, said housing having at least one cutout facing upwards with a dovetail-like appearance transverse to said longitudinal housing direction, said cutout being limited by a bottom, a wall at one end of said cutout and a locking device at the opposite end of said cutout, and B. at least one carrier made in large part from a ceramic material and having at least one upper part and at least one lower part wherein a gap is formed between said carrier and said at least one cutout of said housing, said gap being filled by a ceramic fiber material thereby said rider facilitates a transmission of loads, minimizes heat loss by heat transfer to said tubular support, and accommodates manufacturing tolerances and irregularities in surface shapes, said upper part of said carrier having a surface to carry said charge and said lower part of said carrier having a dovetail-like appearance transverse to said longitudinal housing direction and being placed into said at least one cutout of said housing.

11. A rider according to claim 10 wherein said wall of said cutout transverse to said longitudinal housing direction is rounded.

12. A rider according to claim 10, wherein said gap is filled by at least one of ceramic fiber and mortar.

13. A rider according to claim 10 wherein the upper part of said carrier is rounded transverse to said longitudinal housing direction.

14. A rider according to claim 10 wherein the upper part of said carrier is mushroom-shaped transverse to said longitudinal housing direction.

15. A rider according to claim 10 wherein a shape of the upper part of said carrier transverse to said longitudinal tubular support direction is defined by sides having the same slope as the sides of the lower part of said carrier.

* * * * *

UNITED STATES PATENT AND TRADEMARK OFFICE

CERTIFICATE OF CORRECTION

PATENT NO. : 5,136,610

DATED : August 4, 1992

INVENTOR(S) : Heuss

It is certified that error appears in the above-identified patent and that said Letters Patent is hereby corrected as shown below:

In Claim 9 in column 6 at 19: after "part" (first occurrence) insert --wherein a gap is formed between said carrier and said at least one cutout of said housing, said gap being filled by a ceramic fiber material thereby said rider facilitates a transmission of loads, minimizes heat loss by heat transfer to said tubular support, and accommodates manufacturing tolerances and irregularities in surface shapes--

Signed and Sealed this

Nineteenth Day of December, 1995

*Attest:*

Bruce Lehman

BRUCE LEHMAN

*Attesting Officer*

*Commissioner of Patents and Trademarks*